US007247051B2

(12) United States Patent
Hou

(10) Patent No.: US 7,247,051 B2
(45) Date of Patent: Jul. 24, 2007

(54) ADAPTABLE ELECTRICAL CONNECTOR

(75) Inventor: Pin-Yuan Hou, Taipei (TW)

(73) Assignee: Advanced Connectek Inc., Taipei Hsien (TW)

( * ) Notice: Subject to any disclaimer, the term of this patent is extended or adjusted under 35 U.S.C. 154(b) by 0 days.

(21) Appl. No.: 11/416,236

(22) Filed: May 3, 2006

(65) Prior Publication Data

US 2007/0020995 A1 Jan. 25, 2007

(30) Foreign Application Priority Data

Jul. 22, 2005 (TW) ..... 94212424 U

(51) Int. Cl.
*H01R 13/40* (2006.01)

(52) U.S. Cl. ..... 439/595

(58) Field of Classification Search ..... 439/733.1, 439/595

See application file for complete search history.

(56) References Cited

U.S. PATENT DOCUMENTS 5,749,752 A * 5/1998 Kashiyama et al. ..... 439/733.1
5,954,546 A * 9/1999 Fink et al. ..... 439/595

* cited by examiner

*Primary Examiner*—Briggitte R. Hammond
(74) *Attorney, Agent, or Firm*—Troxell Law Office, PLLC

(57) ABSTRACT

An adaptable electrical connector is disclosed that includes a parallelepiped insulative seat including a front end, a rear end, a bottom, a top, and a plurality of lengthwise parallel grooves through the bottom, the groove being open to the front end, the rear end, and the bottom respectively; and a plurality of cylindrical conductors each including a rear cylindrical section; wherein the conductors are fastened in the grooves with the rear cylindrical sections exposed. The invention can decrease height and is adapted to mount on a PCB in either a first orientation or a second orientation perpendicular to the first orientation.

5 Claims, 3 Drawing Sheets

ADAPTABLE ELECTRICAL CONNECTOR

BACKGROUND OF THE INVENTION

1. Field of Invention

The present invention relates to electrical connectors and more particularly to an adaptable electrical connector with reduced height and being capable of mounting on a PCB (printed circuit board) in either a first orientation or a second orientation perpendicular to the first orientation.

2. Description of Related Art

Adaptable electrical connectors are widely used in many kinds of electronic products (e.g., mobile phones, portable computers, etc.). A conventional adaptable electrical connector 40 is shown in FIG. 1 and comprises a rectangular insulative seat 10, a plurality of conductors 20, and a metal cover 30 of U-section. The cylindrical conductors 20 are physically and electrically connected to a PCB (not shown). The cover 30 is attached onto the seat 10 for the protection of the conductors 20. In use, a user has to remove the cover 30. This has the disadvantages of installing the cover 30, removing same, and increasing the manufacturing cost. Moreover, the adaptable electrical connector 40 is relatively high and such may contradict the trend of developing miniature electronic products. Further, the conductors 20 are mounted in the adaptable electrical connector 40 in a fixed orientation. Thus, the need for improvement still exists in order to overcome the inadequacies of the prior art.

SUMMARY OF THE INVENTION

It is therefore one object of the present invention to provide an adaptable electrical connector comprising a plurality of conductors of cylindrical shape attached to a PCB by soldering so as to reduce height.

It is another object of the present invention to provide an adaptable electrical connector comprising a plurality of conductors adapted to mount on a PCB in either a first orientation or a second orientation perpendicular to the first orientation.

To achieve the above and other objects, the present invention provides an adaptable electrical connector a parallelepiped insulative seat including a front end, a rear end, a bottom, a top, and a plurality of lengthwise parallel grooves through the bottom, the groove being open to the front end, the rear end, and the bottom respectively; and a plurality of cylindrical conductors each including a rear cylindrical section; wherein the conductors are fastened in the grooves with the rear cylindrical sections exposed.

The above and other objects, features and advantages of the present invention will become apparent from the following detailed description taken with the accompanying drawings.

DETAILED DESCRIPTION OF THE INVENTION

Figure 1:
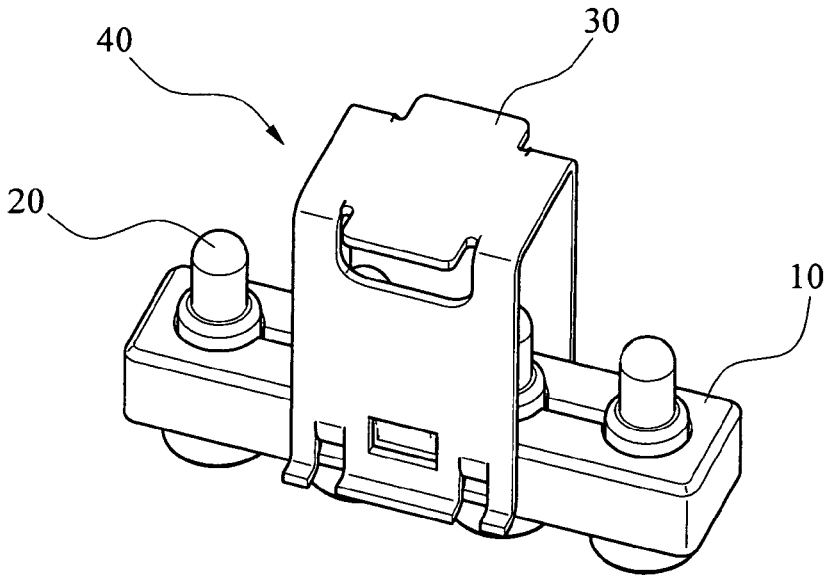
FIG. 1(PRIOR ART)
FIG. 1 is a perspective view of a conventional adaptable electrical connector.
Figure 2:
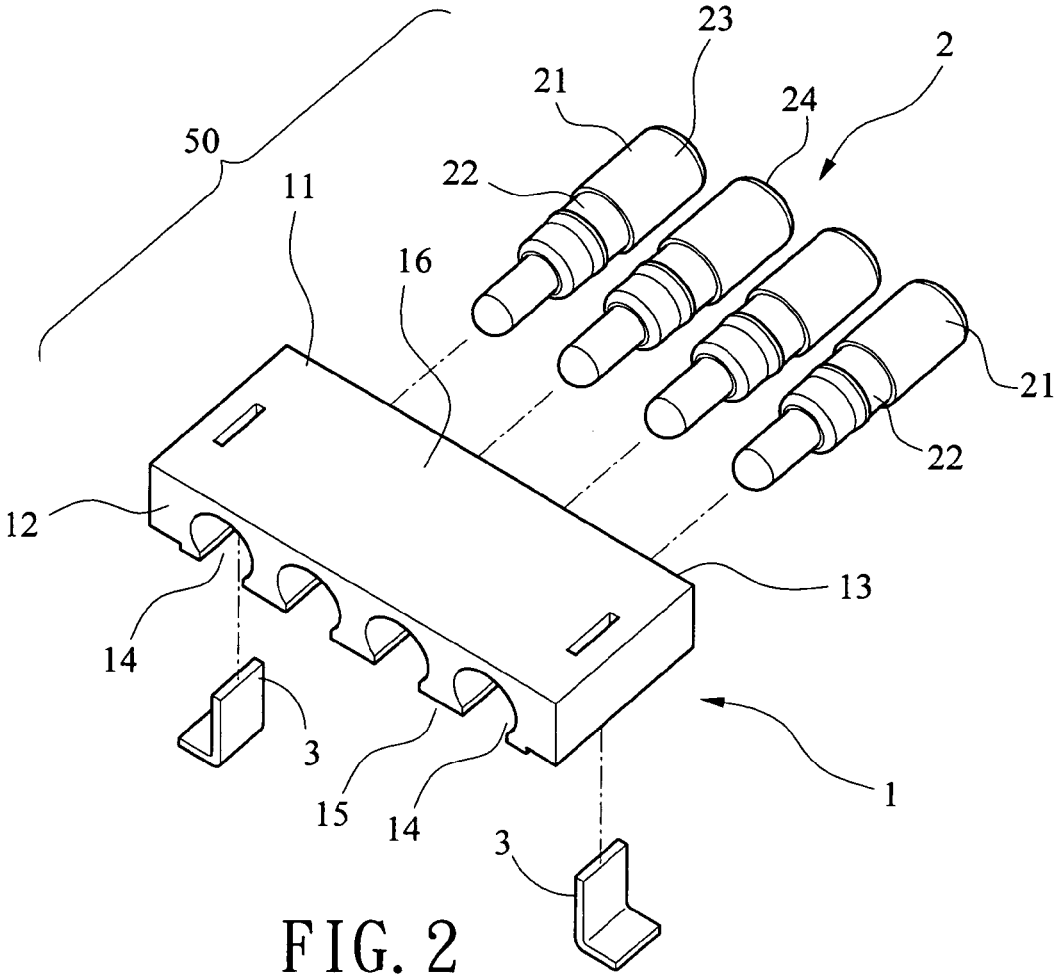
FIG. 2 is an exploded perspective view of a preferred embodiment of adaptable electrical connector according to the invention.
Figure 3:
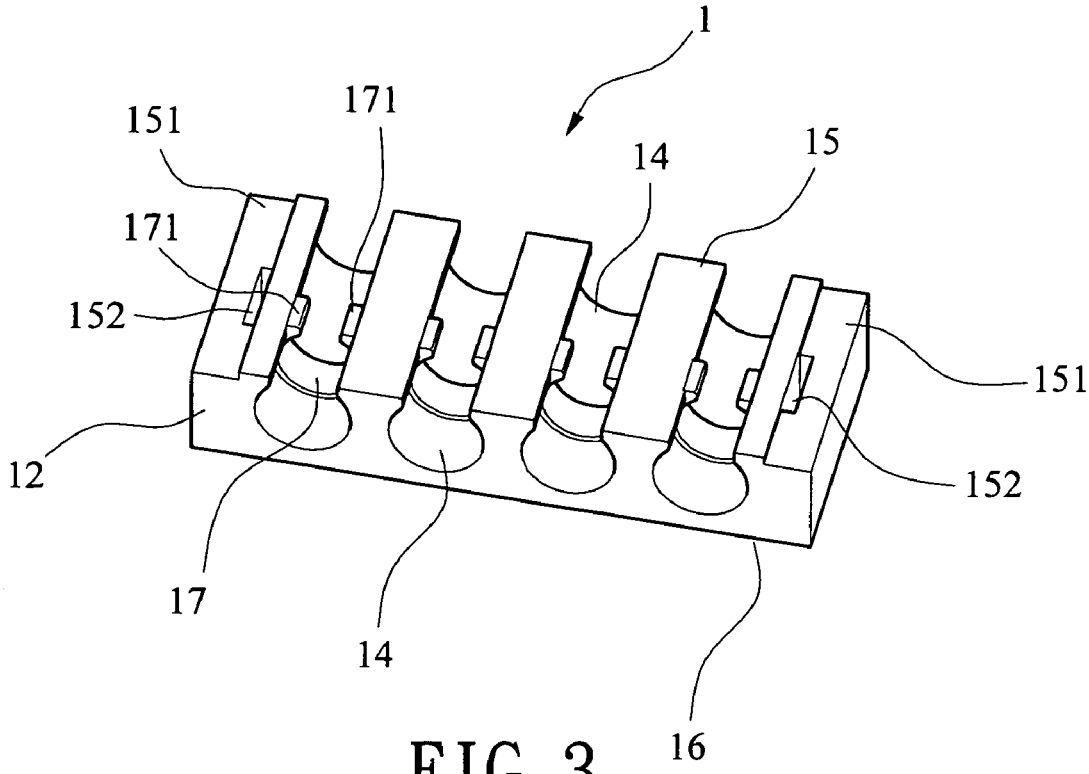
FIG. 3 is a perspective view of the insulative seat of FIG. 2 in an opposite angle.

Referring to FIGS. 2 and 3, an adaptable electrical connector 50 in accordance with a preferred embodiment of the invention comprises an insulative seat 1, a plurality of conductors 2, and two L-shaped mounting plates 3 well known in the art. Each component is discussed in detailed below.

The seat 1 comprises a rectangular body 11 having a bottom 15 and a top 16 both having an area larger than that of the other four side faces (including a front end 12 and a rear end 13) of the body 11, and a plurality of lengthwise parallel grooves 14 through the bottom 15. On the bottom 15 there are provided a rectangular recess 151 at either side, and a channel 152 at either side having both ends open to the bottom 15 and the top 16 respectively. The groove 14 is open to the front end 12, the rear end 13, and the bottom 15 respectively. The groove 14 has an arc section. The groove 14 comprises an intermediate fastening member 17 including two opposite latches 171 on its opening to the bottom 15. Thus, a narrow portion is formed by the latches 171.

The conductor 2 is a staged cylinder 21 and comprises a rear cylindrical section 23, a rear end 24, an intermediate recessed section 22, and a relatively sharp front section.

Figure 4:
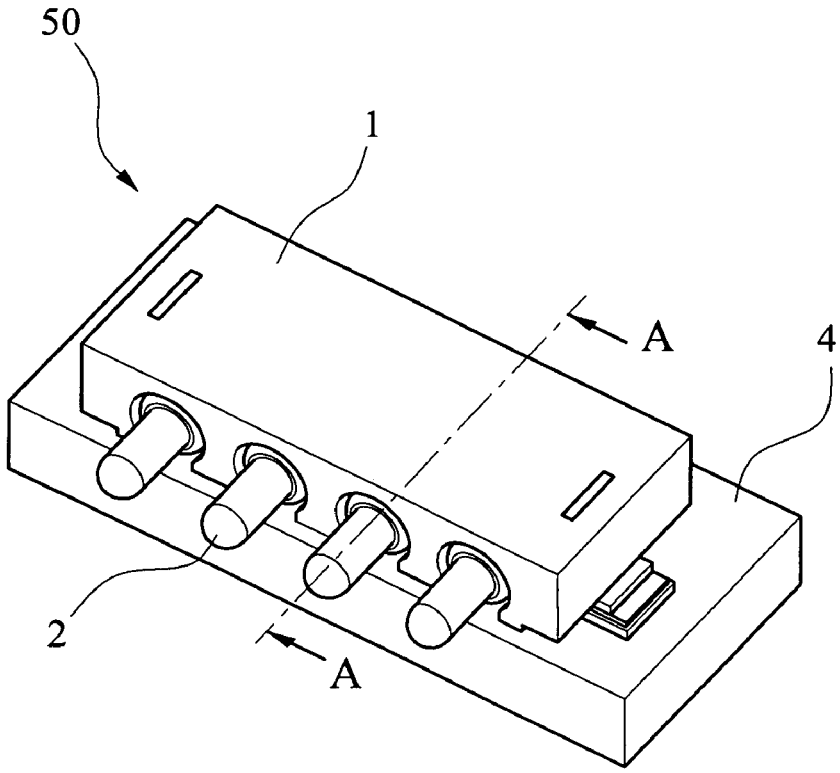
FIG. 4 is a perspective view of the assembled electrical connector of the FIG. 2 mounted on a PCB in one orientation.
Figure 5:
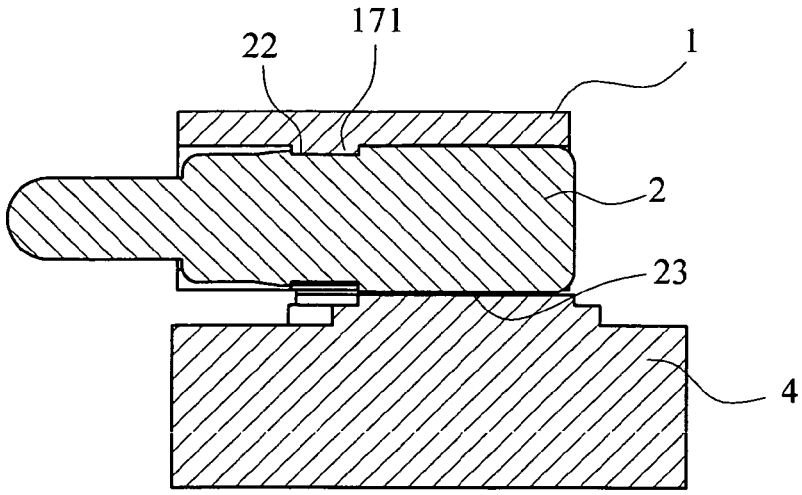
FIG. 5 is a sectional view taken along ling A—A of FIG. 4.

Referring to FIGS. 4 and 5, an assembly of the invention on a PCB 4 in one orientation will be described in detailed below. Insert the conductors 2 into the grooves 14 until the recessed section 22 of each conductor 2 is fastened by the latches 171 of each groove 14. Next, Insert a vertical portion of each mounting plate 3 into the channel 152 from the bottom 15 of the seat 1 and attach a horizontal portion thereof onto a PCB 4. In this state, the seat 1 is mounted on the PCB 4 in a parallel orientation. Also, the rear cylindrical section 23 and the rear end 24 are projected from the rear end 13 of the seat 1 and are electrically connected to the PCB 4. In this orientation, the seat 1 occupies a sufficient area. Thus, the seat 1 can be secured onto the PCB 4 by soldering by means of a SMT (surface mounting) suction member without the cooperation of a metal cover. As a result, the total height of the electrical connector is decreased significantly. This may advantageously contribute to the development of miniature electronic products.

Figure 6:
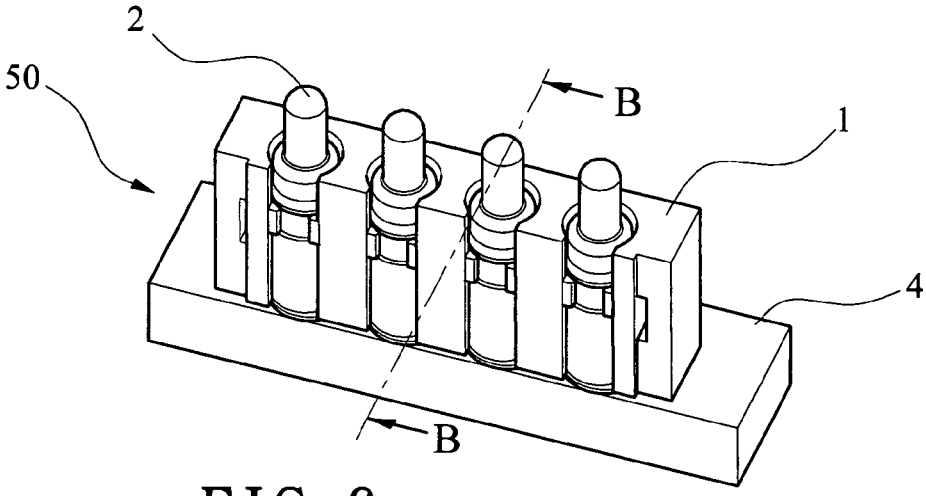
FIG. 6 is a perspective view of the assembled electrical connector of the FIG. 2 mounted on the PCB in the other orientation.
Figure 7:
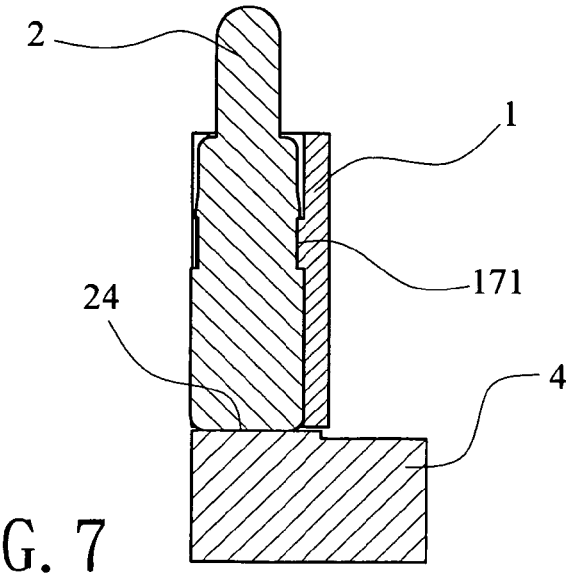
FIG. 7 is a sectional view taken along ling B—B of FIG. 6.

Referring to FIGS. 6 and 7, an assembly of the invention on a PCB 4 in the other orientation will be described in detailed below. Insert the conductors 2 into the grooves 14 until the recessed section 22 of each conductor 2 is fastened by the latches 171 of each groove 14. Next, place the electrical connector 50 on the PCB 4. In this state, the seat 1 is mounted on the PCB 4 in a perpendicular orientation with respect to the PCB 4. Also, the rear cylindrical section 23 and the rear end 24 are projected from the rear end 13 of the seat 1 and are electrically connected onto the PCB 4. In this orientation, the seat 1 occupies a sufficient area. Thus, the seat 1 can be secured onto the PCB 4 by soldering by means of a SMT suction member without the cooperation of a metal cover. This provides an alternate orientation of the electrical connector 5 on the PCB 4.

While the invention herein disclosed has been described by means of specific embodiments, numerous modifications and variations could be made thereto by those skilled in the art without departing from the scope and spirit of the invention set forth in the claims.

What is claimed is:

1. An adaptable electrical connector comprising:

a parallelepiped insulative seat (1) including a front end (12), a rear end (13), a bottom (15), a top (16), and a plurality of lengthwise parallel grooves (14) through the bottom (15), the groove (14) being open to the front end (12), the rear end (13), and the bottom (15) respectively; and a plurality of cylindrical conductors (2) each including a rear cylindrical section (23);

wherein the conductors (2) are fastened in the grooves (14) with the rear cylindrical sections (23) exposed, wherein the conductor (2) further comprises a rear end (24) formed on the rear cylindrical section (23) and projected from the rear end (13), and wherein the rear end (24) and the rear cylindrical section (23) are adapted to electrically connect to the PCB (4) in either a first orientation or a second orientation perpendicular to the first orientation.

2. An adaptable electrical connector comprising:

a parallelepiped insulative seat (1) including a front end (12), a rear end (13), a bottom (15), a top (16), and a plurality of lengthwise parallel grooves (14) through the bottom (15), the groove (14) being open to the front end (12), the rear end (13), and the bottom (15) respectively; and a plurality of cylindrical conductors (2) each including a rear cylindrical section (23) and a round front section projected from the front end (12);

wherein the conductors (2) are fastened in the grooves (14) with the rear cylindrical sections (23) exposed, wherein the groove (14) comprises an intermediate fastening member (17) including two opposite latches (171) on its opening to the bottom (15), and wherein the conductor (2) further comprises an intermediate recessed section (22) being fastened by the latches (171).

3. An adaptable electrical connector comprising:

a parallelepiped insulative seat (1) including a front end (12), a rear end (13), a bottom (15), a top (16), and a plurality of lengthwise parallel grooves (14) through the bottom (15), the groove (14) being open to the front end (12), the rear end (13), and the bottom (15) respectively; and a plurality of cylindrical conductors (2) each including a rear cylindrical section (23);

wherein the conductors (2) are fastened in the grooves (14) with the rear cylindrical sections (23) exposed, wherein the rear cylindrical section (23) is projected from the seat (1) and is electrically connected to a PCB (4).

4. The adaptable electrical connector of claim 3, further comprising two L-shaped mounting plates (3) secured to the bottom (15) of the seat (1).

5. The adaptable electrical connector of claim 3, wherein the conductor (2) further comprises a round front section projected from the front end (12).

* * * * *